United States Patent [19]

Fukata

[11] 4,454,189

[45] Jun. 12, 1984

[54] SHEET OF POLYPHENYLENE SULFIDE FILAMENTS AND PROCESS FOR PRODUCING THE SAME

[75] Inventor: Shunsuke Fukata, Kusatsu, Japan

[73] Assignee: Toray Industries, Inc., Tokyo, Japan

[21] Appl. No.: 348,007

[22] PCT Filed: Jun. 24, 1981

[86] PCT No.: PCT/JP81/00145

§ 371 Date: Feb. 8, 1982

§ 102(e) Date: Feb. 8, 1982

[87] PCT Pub. No.: WO82/00163

PCT Pub. Date: Jan. 21, 1982

[30] Foreign Application Priority Data

Jun. 27, 1980 [JP] Japan ..... 55-86568

[51] Int. Cl.[3] ..... D01D 5/10; D04H 3/10

[52] U.S. Cl. ..... 428/224; 19/296; 28/104; 28/107; 28/116; 28/122; 264/176 F; 264/210.2; 264/280; 264/324; 428/288; 428/290; 428/339; 428/340; 428/364; 428/369; 428/401; 528/388

[58] Field of Search ..... 528/388; 428/288, 290, 428/339, 340, 369, 401, 364, 324, 224; 19/296; 28/104, 107, 116, 122; 264/176 F, 210.2, 280

[56] References Cited

U.S. PATENT DOCUMENTS

| | | | |
|---|---|---|---|
| 3,354,129 | 11/1967 | Edmonds et al. | 528/388 |
| 3,895,091 | 7/1975 | Short et al. | 528/338 |
| 3,912,695 | 10/1975 | Short et al. | 528/338 |

*Primary Examiner*—James C. Cannon
*Attorney, Agent, or Firm*—Austin R. Miller

[57] ABSTRACT

This invention relates to a sheet which is formed by randomly dispersing and accumulating polyphenylene sulfide (PPS) filaments and to a process for producing the same. The filaments drawn by a high-velocity air stream are formed directly into a sheet. The sheet is useful as industrial filters, heat insulating materials, electrical insulating materials, etc. because of its outstanding chemical resistance, heat resistance, and electrical insulating properties.

20 Claims, No Drawings

SHEET OF POLYPHENYLENE SULFIDE FILAMENTS AND PROCESS FOR PRODUCING THE SAME

DESCRIPTION

Technical Field

The present invention relates to a fibrous sheet which is superior in heat resistance, chemical resistance, flame retardancy, electrical insulating properties, and strength. More particularly, the invention relates to a fibrous sheet of polyphenylene sulfide (referred to as PPS hereinafter) filaments and a process for producing the same.

Background Art

PPS is known as a thermoplastic polymer having superior chemical resistance and heat resistance, as disclosed in U.S. Pat. No. 3,912,695. That PPS is also capable of being melt spun is disclosed in Japanese Patent Publication Nos. 52-12240 (1977) and 52-30609 (1977). In practice, however, it is impossible to produce invariably PPS filaments of uniform quality. In other words, PPS polymer having a viscosity suitable for melt spinning is liable to form particulate gels which cause quite often breakage of filaments during spinning and drawing. This tendency is pronounced in the case of fine filaments. On the other hand, if the viscosity is lowered to avoid gelation, the resulting PPS polymer is so poor in spinnability and so brittle that the filaments spun from such PPS polymer are easily broken by friction with guides. Furthermore, such PPS filaments produced by some means or other are stiff, liable to static build-up, slippery, lacking the bunching property and even twisting and doubling are difficult to perform, not to mention crimping. It is also difficult to make a uniform sheet from such PPS filaments by knitting, weaving, or carding. In addition, PPS fibers do not disperse very well into water because they are extremely hydrophobic. This makes PPS fibers unsuitable for making sheets therefrom in the papermaking manner. Such being the case, fibrous sheets of PPS polymer having high strength and uniform quality have not been produced easily.

Disclosure of Invention

The present invention discloses the following.

1. A sheet of PPS filaments which comprises randomly dispersed and accumulated PPS filaments, each having a fineness of 0.1 to 15 denier.

2. A process for producing a sheet of PPS filaments which comprises extruding a PPS polymer from a plurality of small holes at a temperature 20° to 85° C. higher than the melting point of the PPS polymer, drawing apart the extrudate from the small holes at a rate greater than 1300 m/min by a high-velocity air stream, simultaneously causing the resulting filaments to be separated by electrostatic charge, collecting the separated filaments on a plane, and bonding or interlocking the collected filaments.

Best Mode for Carrying Out the Invention

According to the process of this invention for producing a sheet of PPS filaments, a molten PPS polymer is extruded from small holes and then the extrudate is conveyed by an air stream, without contact with guides and rollers. This makes it possible to produce a fibrous sheet without frequent breakage of filaments and troubles of broken filaments being caught in rollers. More specifically, the fluid extrudate is introduced to the inside of an annular air jet or the outside of a cylindrical air jet so that the extrudate is drawn apart from the small holes. In another way, the molten polymer is extruded from small holes into a pressurized compartment and the extrudate is blown out at a high speed together with a pressurized fluid ejected from the nozzle opposite to the small holes. The spinning speed should be at least 1300 m/min, preferably 3000 m/min and over. It is not difficult to realize a spinning speed greater than 5000 m/min, if the above-mentioned method is employed. According to the process mentioned above, it is possible to produce fibers having a strength greater than 1.5 g/d and a dry heat shrinkage of 5 to 40% at 140° C. The spinning temperature should be 20° C., preferably 30° to 60° C., higher than the melting point of the polymer. The small holes have a diameter from 0.1 to 1.0 mm, and the number of the small holes is usually greater than ten. The distance between the small holes and the air jet is usually 200 to 2000 mm. Too short a distance causes filament breakage; and too long a distance decreases the spinning speed, with a resulting reduced strength of filaments. The adequate distance should be increased or decreased in proportion to the fineness of filaments to be produced.

There is a general trend that the higher the draft ratio, the higher the orientation. The running filaments can be electrostatically charged by bringing a high-voltage electrode into direct contact with the filaments or by simply bringing it into contact with the guide wall or reflector of the air jet. Such a method provides a web which is uniform in the weight per unit area.

The web should preferably be treated for static elimination or bonded temporarily by a hot press so that the web is not disturbed when peeled off from the collecting plane.

Usually, it is inevitable that the filaments come in slight contact with the air jet wall surface or the vicinity thereof that generates a high-velocity air stream, but it is possible to prevent the filaments from being damaged if the curvature of the contacting surface is increased or the contacting angle is decreased. This is also true in the case where the filaments are caused to impinge against a solid face and to rebound from it together with an air stream in order to accomplish separating.

The process of the present invention provides PPS filaments almost as strong as the conventional PPS oriented filaments if the spinning speed is increased. In addition, it does not cause necking which is noticed on undrawn filaments. Being made up of filaments, the sheet of this invention is superior in strength to nonwoven fabrics made up of short fibers. The effect of filaments is remarkable when bonding points or interlocking points are decreased to improve flexibility.

The PPS polymer used in the present invention should have a melt viscosity from 300 to 100,000 poise, preferably 600 to 20,000 poise, at a shear rate of 200 $sec^{-1}$ at 300° C. One having too low a viscosity can be increased in viscosity by preliminary curing as disclosed in Japanese Patent Publication No. 52-30609 (1977), at the sacrifice of spinnability.

According to the present invention, it is also possible to produce mixed filaments if PPS polymers of different types are extruded from small holes separated for each type and the extruded filaments are mixed in the air stream. In such a case, it is also possible to utilize filaments of one type of PPS polymers as an adhesive for heat-bonding or to cause filaments of one type of PPS polymers to shrink so that the web of filaments is made bulky.

The filaments constituting the web should have a fineness of 0.1 to 15 denier, preferably 0.5 to 5 denier, and the web of filaments should have a weight of 10 to 600 g/m$^2$, preferably 20 to 300 g/m$^2$. Such webs can be laminated with ease. The web of filaments should have an area shrinkage of 5 to 80%, preferably 10 to 60%, more preferably 15 to 40% (measured according to JIS C-2111 providing the method for measuring the area shrinkage of paper), from the view point of subsequent heat treatment process. Any web having an area shrinkage exceeding 80% leads to products which are poor in dimensional stability and quality.

The web of filaments of this invention becomes bulky and flexible when subjected to the slackening heat treatment at 100° to 180° C., preferably 120° to 160° C., which crimps the constituting filaments. In addition, the web may be imparted a variety of characteristics such as bulkiness, strength, flexibility, if the web undergoes interlocking by needle punching or water jet interlacing prior to the heat treatment. For effective crimping, the needle punching should be performed at a density of 30 to 300 needles/cm$^2$, preferably 50 to 200 needles/cm$^2$. Webs having a weight of 200 g/m$^2$ and over are less liable to the damage of filaments and hence maintain high strength. Incidentally, the interlocking by water jet is preferable for PPS webs because it damages the filaments only a little. The method as disclosed in Japanese Patent Publication No. 48-13749 (1973) may be employed. According to this method, a web placed on a porous support is subjected to water treatment continuously or intermittently, with the web and support being moved relatively each other. This method is suitable for thin webs having a weight of 50 to 300 g/m$^2$ because the water jet does not penetrate thick webs easily. Unlike needle punching, the water jet method provides a smooth surface having almost no needle marks.

The term "PPS polymer" as used herein denotes homopolymers or copolymers made up of p-phenylene sulfide units. They can be obtained by condensation of p-dichlorobenzene and sodium sulfide. In the case where a plurality of PPS polymers different in melting points or shrinkage are to be used, selection should be made according to the degree of their copolymerization. Examples of comonomers include m-dichlorobenzene, 1,2,4-trichlorobenzene, and other compounds having a diphenylether group, diphenylsulphone group, or naphthalene nucleus. Trichlorobenzene should not be copolymerized in an amount more than 1%, because it impairs the spinnability of the resulting polymer. In the case where a plurality of polymers are used, it is preferable that the content of comonomers in the main polymer is less than 10%. Within such a limit, the PPS polymer keeps its fundamental properties regardless of the types of comonomers used.

The linear PPS polymer of high polymerization degree is especially suitable for this invention. Such a polymer is obtained by adding an alkali metal salt of carboxylic acid such as lithium acetate at the time of polymerization.

The degree of crosslinking and branching of a polymer can be defined by the non-Newtonian constant n represented by the following formula.

$$\dot{r} = \frac{1}{\mu} T^n$$

(wherein $\dot{r}$ is shear rate, T is shear force, and $\mu$ is apparent viscosity.) The value n is obtained by approximation from the plotting of $\dot{r}$. It increases in proportion to the degree of crosslinking and branching. The polymer having $0.9<n<3.0$, preferably $0.9<n<2.0$, is suitable for this invention.

Such a polymer is superior in spinnability and less liable to gelation during melt spinning. It is worthy of special mention that the melt spinning speed is remarkably increased—up to 2000 m/min, even up to 4000 m/min—when the filaments are taken up by an air stream. Such an extremely high spinning speed is incredible, but is factual. The high spinning speed results in a great increase in strength, Young's modulus, and elongation, and a decrease in shrinkage.

On hot pressing, the sheet of PPS filaments turns to a compact paperlike sheet. If the sheet is allowed to shrink simultaneously with hot pressing, the resulting sheet will be made more compact. Before or after hot pressing, the sheet may be given a heat resistant binder such as polyimide, polyamide-imide, aromatic polyamide, polybenzimidazole, and polyarylenesulfide, in an amount of 5 to 90 wt% based on the filaments, by dipping, coating, spraying, or dusting.

The non-woven fabric of this invention may be made substantially insoluble if treated with an oxidizing agent such as sodium hypochlorite. Such a product will be useful as industrial filters, firemen's wear, etc. which are exposed to an intense heat.

EXAMPLE 1

Linear high-molecular weight PPS was prepared by reacting 1 mole of sodium sulfide, 0.14 mole of sodium hydroxide, and 0.90 mole of lithium acetate in N-methylpyrrolidone under nitrogen at 200° C. with distillation of water, and further reacting, after adding 1.02 mole of p-dichlorobenzene, under pressure at 270° C.

The resulting polymer had a melt viscosity of 2900 poise at a shear rate of 200 sec$^{-1}$ at 300° C. and n=1.25.

This polymer was melted at 340° C. and extruded through a spinneret having 20 small holes, each measuring 0.7 mm in diameter, at a rate of 0.5 g/min/hole and 1.3 g/min/hole. The extrudate was introduced into an aspirator which was installed 40 cm under the spinneret. The filaments discharged from the aspirator were found to have the characteristics as shown in Table 1

The web made up of filaments having the characteristics shown in Table 1 was sampled as described in Example 4. The web was found to have a weight of about 350 g/m$^2$. The web underwent needle punching with 0.028-inch thick needles, each having a triangular cross-section and nine barbs at the tip, at a density of 160 needles/cm$^2$. The resulting felt underwent free shrinkage with hot air at 140° C. blown by a drier, and a piece of bulky felt was obtained. The shrinkage by heat treatment was 21% in the longitudinal direction and 25% in the lateral direction. The investigation on the crimp characteristics of some filaments extracted from the felt revealed helical three-dimensional crimps, with an average of 18 crimps per inch. The felt was found to have the following mechanical properties which are based on the converted weight of 100 g/m$^2$.

| | | |
|---|---|---|
| Breaking tenacity: | Longitudinal | 4.3 kg/25 mm width |
| | Lateral | 2.7 kg/25 mm width |

TABLE 1

| Specimen No. | Throughput per hole (g/min) | Air pressure of aspirator (kg/cm$^2$.G) | Fineness (denier) | Maximum spinning speed (m/min) | Breaking tenacity (g/d) | Breaking extension (%) | Young's modulus (g/d) | Heat shrinkage (160° C. × 10 min) (%) |
|---|---|---|---|---|---|---|---|---|
| 1 | 0.5 | 0.8 | 1.44 | 3120 | 1.93 | 75 | 19 | 69.5 |
| 2 | 1.3 | 2.2 | 1.79 | 6550 | 2.16 | 40 | 25 | 4.0 |
| 3* | 1.3 | 2.2 | 1.84 | 7370 | 1.71 | 34 | 25 | 4.1 |
| 4* | — | — | — | — | 2.64 | 36 | 39 | — |
| 5* | — | — | — | — | 2.78 | 32 | 41 | — |
| 6* | — | — | — | — | 2.90 | 26 | 43 | — |
| 7* | — | — | — | — | 1.24 | 67 | — | — |
| 8* | — | — | — | — | 2.74 | 30 | — | — |

3* Melt spinning temperature at 360° C.
4* Prepared by free heat treatment of specimen No. 2 at 160° C.
5* Prepared by constant length heat treatment of specimen No. 2 at 160° C.
6* Prepared by constant length heat treatment of specimen No. 2 at 200° C.
7* Prepared by free heat treatment of specimen No. 1 at 160° C.
8* Prepared by constant length heat treatment of specimen No. 1 at 160° C.

| | | |
|---|---|---|
| Breaking extension: | Longitudinal | 147% |
| | Lateral | 50% |
| Tear strength: | Longitudinal | 2 kg/tongue method |
| | Lateral | 1.5 kg |
| Tenacity at 5% extension: | Longitudinal | 0.5 kg/25 mm width |
| | Lateral | 0.3 kg/25 mm width |

These characteristic values, which are comparable to those of the conventional polyester spun bond felt, suggest that the felt in this example can be put to practical use. Incidentally, the polyester felt treated under the same conditions gave a breaking strength of 5 to 8 kg, an extension of 80 to 100%, and tear strength of 2 to 4 kg.

On the other hand, an attempt was made to prepare a web by carding from the staple of the filaments used in this example. But no web was made because of the breakage of fibers. This proved the advantage of making heat and chemical resistant felt from filaments of PPS polymer.

EXAMPLE 2

Example 1 was repeated except that the density of needle punching for the resulting web was changed to 10, 50, 200, 300, and 400 per cm$^2$. The mechanical properties of the resulting felt are given below as index values, with the values in Example 1 being 100.

| | | | | | |
|---|---|---|---|---|---|
| Density of needle punching | 10 | 50 | 200 | 300 | 400 |
| Tenacity at 5% extension | 10 | 57 | 130 | 85 | 40 |
| Breaking tenacity | 20 | 70 | 140 | 90 | 50 |
| Tear strength | 10 | 100 | 90 | 70 | 10 |

These values indicate that a density of 10 needles/cm$^2$ does not provide sufficient strength due to insufficient interlocking of filaments, and that strength rather decreases at a density of 400 needles/cm$^2$ because of mechanical damage of filaments.

EXAMPLE 3

The web made up of the filaments No. 1 prepared in Example 1 was subjected to interlocking by water jet as follows: A web having a weight of about 150 g/m$^2$ was placed on an 80 mesh metal screen which moves intermittently, and a water jet was applied at a pressure of 70 kg/cm$^2$ to the web from a nozzle placed 30 cm above the web, the nozzle having 0.13 mm holes arranged in one row at intervals of 3 mm. After dewatering and drying at 110° C., the web underwent heat treatment under a load of about 100 g/cm$^2$ at 180° C. for 30 minutes. The resulting felt was found to have an apparent specific gravity of 0.39 g/cc and the following mechanical properties which are based on the converted weight of 100 g/m$^2$.

| | | |
|---|---|---|
| Breaking tenacity: | Longitudinal | 8.0 kg/25 mm width |
| | Lateral | 6.5 kg/25 mm width |
| Breaking extension: | Longitudinal | 180% |
| | Lateral | 210% |
| Tear strength: | Longitudinal | 3.6 kg/tongue method |
| | Lateral | 2.8 kg |
| Tenacity at 5% extension: | Longitudinal | 0.8 kg/25 mm width |
| | Lateral | 0.7 kg/25 mm width |

The resulting feltlike product was found to have a high practical value.

EXAMPLE 4

PPS polymer filaments were prepared as follows from a branched PPS polymer ("RYTON" made by Phillips Petroleum Co.) having a melting point of 277° C. and a melt viscosity of 2000 poise at a shear rate of 200 sec$^{-1}$ at 300° C.

This polymer was melted at 320° C. and extruded through a spinneret having 20 small holes, each measuring 0.7 mm in diameter, at a rate of 0.3 g/min/hole. The extrudate was introduced into an aspirator which was installed 60 cm under the spinneret and was supplied with pressurized air of 1 kg/cm$^2$.G. The PPS filaments were discharged from the aspirator at a rate of 1700 m/min. The filaments obtained were found to have a fineness of 1.6 denier, a breaking tenacity of 1.7 g/denier, a breaking extension of 120%, and a free shrinkage of 45% at 160° C. for 10 minutes.

The filament bundle was opened by making it electrostatically charged by a corona discharge apparatus mounted immediately above the aspirator, the apparatus consisting of a needle electrode and a grounding electrode having a diameter of 20 mm, with a potential of minus 15000 volts applied across the electrodes 8 mm apart. The opened filaments were collected in the form of a thin layer on a 30 mesh screen placed under the aspirator.

On reeling the filaments from the web, it was found that the filaments are distributed as far as 30 cm from the point directly below the aspirator.

A 40 cm wide web having a weight of 55 g/m$^2$ was prepared by collecting the filaments continuously on a moving screen. After eliminating static charge, the web was removed from the screen. The non-woven fabric thus prepared was found to have an area shrinkage of 36% when measured for a 10×10 cm sample heated in an oven at 160° C.

The non-woven fabric was then passed through calender rolls at 160° C. under a load of 500 kg/m, to be pressed into a 0.2 mm thick compact smooth paperlike sheet. The sheet was found to be stable enough to withstand a various kinds of wet treatments. As an example, the sheet was impregnated with a 30% N-methylpyrrolidone solution of polyimide for a pick-up of 25% based on the weight of the filaments. This sheet had the following characteristics after curing at 180° C. for 1 hour.

(1) As such

| | |
|---|---|
| Breaking tenacity: | 3.3 kg/15 mm width |
| Breaking extension: | 10% |
| Tear strength: | 0.7 kg |

(2) After heating at 180° C. for 50 hours

| | |
|---|---|
| Breaking tenacity: | 3.1 kg/15 mm width |
| Breaking extension: | 7% |
| Tear strength: | 0.7 kg |

In the meantime, when the air pressure for the aspirator was increased to 1.5 kg/cm$^2$, it was impossible to make a sheet because of excessive filament breakage.

Industrial Applicability

The sheet of PPS filaments of this invention is superior in heat resistance, chemical resistance, flame retardance, electrical insulating properties, and mechanical strength. When it comes to heat resistance over a long period of time, the sheet of this invention is comparable to Class F films.

The sheet of this invention is not attacked by any solvent at lower than 200° C. Because of these characteristics, the sheet will find use as industrial filters, gaskets, packings, firemen's wear, reinforcement substrates, heat insulating materials, etc. if made bulky and flexible; and as electrical insulating materials, speaker cones, circuit boards, battery separtors, etc. if made compact.

What is claimed is:

1. A sheet of polyphenylene sulifide filaments which comprises randomly dispersed and accumulated polyphenylene sulfide filaments, each having a fineness of 0.1 to 15 denier, a dry heat shrinkage of about 5–50% at 140° C. and a strength greater than 1.5 g/d, wherein said filaments are made of a linear polymer having a degree of crosslinking and branching as defined by the non-Newtonian constant n of $0.9<n<2.0$ as defined by the formula $$r = \frac{1}{\mu} T^n$$

wherein r is shear rate, T is shear force and $\mu$ is viscosity.

2. A sheet of polyphenylene sulfide filaments as claimed in claim 1, wherein said p-phenylene sulfide is copolymerized with a comonomer selected from the group consisting of m-dichlorobenzene, 1,2,4-trichlorobenzene, compounds having a diphenylether group, compounds having a diphenyl sulphone groups and compounds having a naphthalene nucleus.

3. A sheet of polyphenylene sulfide filaments as claimed in claim 1, wherein said PPS filaments have a shrinkage of 5 to 40% at 140° C.

4. A sheet of polyphenylene sulfide filaments as claimed in claim 1, wherein said polyphenylene sulfide filaments are bonded with at least one thermosetting resin selected from the group consisting of polyimide, polyamide-imide, aromatic polyamide, polybenzimidazole, and polyarylene sulfide.

5. A sheet of polyphenylene sulfide filaments as claimed in claim 4, wherein the quantity of said thermosetting resin is 5 to 90 wt% based on the quantity of the filaments.

6. A sheet of polyphenylene sulfide filaments as claimed in claim 1, wherein said filaments are felted by interlocking.

7. A web of polyphenylene sulfide filaments to be bonded or interlocked comprising randomly dispersed and accumulated polyphenylene sulfide filaments, wherein said filaments are 0.5 to 5 denier, said web has an area shrinkage of 5 to 80% and, said filaments have a dry heat shrinkage of about 5–40% at 140° C. and a strength greater than 1.5 g/d, said filaments are made of a linear polymer having a degree of cross-linking and branching as defined by the non-Newtonian constant n of $0.9<n<2.0$ as defined by the formula $$r = \frac{1}{\mu} T^n$$

wherein r is shear rate, T is shear force and $\mu$ is viscosity.

8. A web of polyphenylene sulfide filaments as claimed in claim 7, wherein said web weighs 10 to 600 g/m$^2$.

9. A web of polyphenylene sulfide filaments as claimed in claim 7, wherein said web has an area shrinkage of 10 to 60%.

10. A web of polyphenylene sulfide filaments as claimed in claim 7, wherein said web has an area shrinkage of 15 to 40%.

11. A web of polyphenylene sulfide filaments as claimed in claim 7, wherein said web weighs 20 to 300 g/m$^2$.

12. A process for producing a sheet of polyphenylene sulfide filaments which comprises extruding a polyphenylene sulfide polymer from a plurality of small holes at a temperature 20° to 85° C. higher than the melting point of the polyphenylene sulfide polymer, drawing apart the extrudate from the small holes at a rate greater than 1300 m/min by a high-velocity air stream, simultaneously causing the resulting filaments to be opened by electrostatic charge, collecting the opened filaments on a plane, and bonding or interlocking the collected filaments.

13. A process for producing a sheet of polyphenylene sulfide filaments as claimed in claim 12, wherein said PPS polymer is composed of more than 90 mol% of p-phenylene sulfide units and has "n" which is represented by $0.9<n<3.0$ (where n is as defined in the specification).

14. A process for producing a sheet of polyphenylene sulfide filaments as claimed in claim 13, wherein said polyphenylene sulfide polymer has "n" which is represented by $0.9<n<2.0$.

15. A process for producing a sheet of polyphenylene sulfide filaments as claimed in claim 12, wherein said polyphenylene sulfide polymer has a melt viscosity of 300 to 100,000 poise at a shear rate of 200 $sec^{-1}$ at 300° C.

16. A process for producing a sheet of polyphenylene sulfide filaments as claimed in claim 12, wherein the extrudate is drawn apart from the small holes at a rate greater than 1300 m/min by a high-velocity air stream.

17. A process for producing a sheet of polyphenylene sulfide filaments as claimed in claim 12, wherein the extrusion temperature is 30° to 60° C. higher than the melting point of the polyphenylene sulfide polymer.

18. A process for producing a sheet of polyphenylene sulfide filaments as claimed in claim 12, wherein the interlocking is performed by needle punching.

19. A process for producing a sheet of polyphenylene sulfide filaments as claimed in claim 12, wherein the interlocking is performed by water jet.

20. A process for producing a sheet of polyphenylene sulfide filaments as claimed in claim 12, wherein a heat bonding process and a compacting process using a hot calendering machine are added.

* * * * *